United States Patent [19]

Coyne

[11] 4,227,382

[45] Oct. 14, 1980

[54] SPLIT SYSTEM AIR CONDITIONER ADAPTED TO RECEIVE A WATER PREHEATER

[75] Inventor: Gerard G. Coyne, Tyler, Tex.

[73] Assignee: General Electric Company, Louisville, Ky.

[21] Appl. No.: 948,594

[22] Filed: Oct. 4, 1978

[51] Int. Cl.[3] ..... F25B 13/00; F25B 27/02

[52] U.S. Cl. ..... 62/324; 62/238

[58] Field of Search ..... 62/117, 324 D, 238 E, 62/298, 299, 196 B

[56] References Cited

U.S. PATENT DOCUMENTS

| | | | |
|---|---|---|---|
| 1,874,803 | 8/1932 | Reed | 62/238 E |
| 2,690,649 | 10/1954 | Borgerd | 62/238 E |
| 2,881,011 | 4/1959 | Coughlin | 248/18 |
| 2,934,915 | 5/1960 | Morse | 62/299 |
| 3,188,829 | 6/1965 | Siewert et al. | 62/160 |
| 3,230,732 | 1/1966 | Rutishauser et al. | 62/299 |
| 3,301,002 | 1/1967 | McGrath | 62/238 E |
| 3,308,877 | 3/1967 | Gerteis | 62/238 E |
| 3,850,006 | 11/1974 | Redfern et al. | 62/299 |
| 3,916,638 | 12/1975 | Schmidt | 62/238 E |
| 3,984,050 | 10/1976 | Gustafsson | 62/238 E |
| 4,069,686 | 1/1978 | Hoelman | 62/292 |
| 4,103,510 | 8/1978 | Hall | 62/299 |

*Primary Examiner*—Lloyd L. King

*Attorney, Agent, or Firm*—Frank P. Giacalone; Radford M. Reams

[57] ABSTRACT

An apparatus and method of attaching an auxiliary heat exchanger to a split refrigeration system. The auxiliary heat exchanger is in heat transfer relationship with a supply of water. Connectors are provided in bypass relationship with a valve arranged in the liquid line. The auxiliary heat exchanger, when desired, is closed placing the auxiliary heater in series flow relationship with the system condenser.

1 Claim, 2 Drawing Figures

SPLIT SYSTEM AIR CONDITIONER ADAPTED TO RECEIVE A WATER PREHEATER

BACKGROUND OF THE INVENTION

This invention relates to a refrigeration system and more particularly to a refrigeration system adapted to receive an auxiliary water preheating apparatus.

Many products are available which may, during the warmer months, cool and dehumidify the home and, during the colder months, heat the home and additionally satisfy at least a portion of the hot water demands of the home. Some known prior art attempts have required that the refrigeration system be specifically designed and assembled to provide water preheating capabilities. In this instance, the water preheater is an integral part of the total system and is sold to include the water preheating portion as an integral part of the purchased product. Other prior art attempts require that extensive modifications be made to the standard refrigeration system to receive a water preheating apparatus. These modifications must be made at the time the system is installed. In the latter instance, the sealed unit must be opened and then recharged which requires the employment of knowledgeable service people and an extreme amount of care so as to not contaminate the system prior to resealing and recharging.

It is a principal object of the present invention to provide a new and improved apparatus for conditioning an enclosure and heating water.

It is an object of the present invention to provide an air conditioning unit which is adapted to selectively receive a water heating apparatus.

SUMMARY OF THE INVENTION

This invention is illustrated as a split refrigeration system air conditioner including an outdoor section having a compressor and an outdoor heat exchanger and an indoor section having an indoor heat exchanger, but it is understood that it could be applied equally to a self-contained system. The compressor discharge is directed to the system condenser and includes a valve. A first line means in the outdoor section is connected at one end to the discharge line upstream of the valve and is provided with connector means at its other end. A second line means in the outdoor section is connected at one end to the discharge line downstream of the valve and is provided with connector means at its other end. An auxiliary heat exchanger is provided including means for placing water in heat transfer relationship with the auxiliary heat exchanger. The auxiliary heat exchanger has its inlet and outlet attached to the first and second line connectors respectively so as to be in series flow arrangement with the system condenser when the valve is in its closed position.

DESCRIPTION OF THE PREFERRED EMBODIMENT

Figure 1:
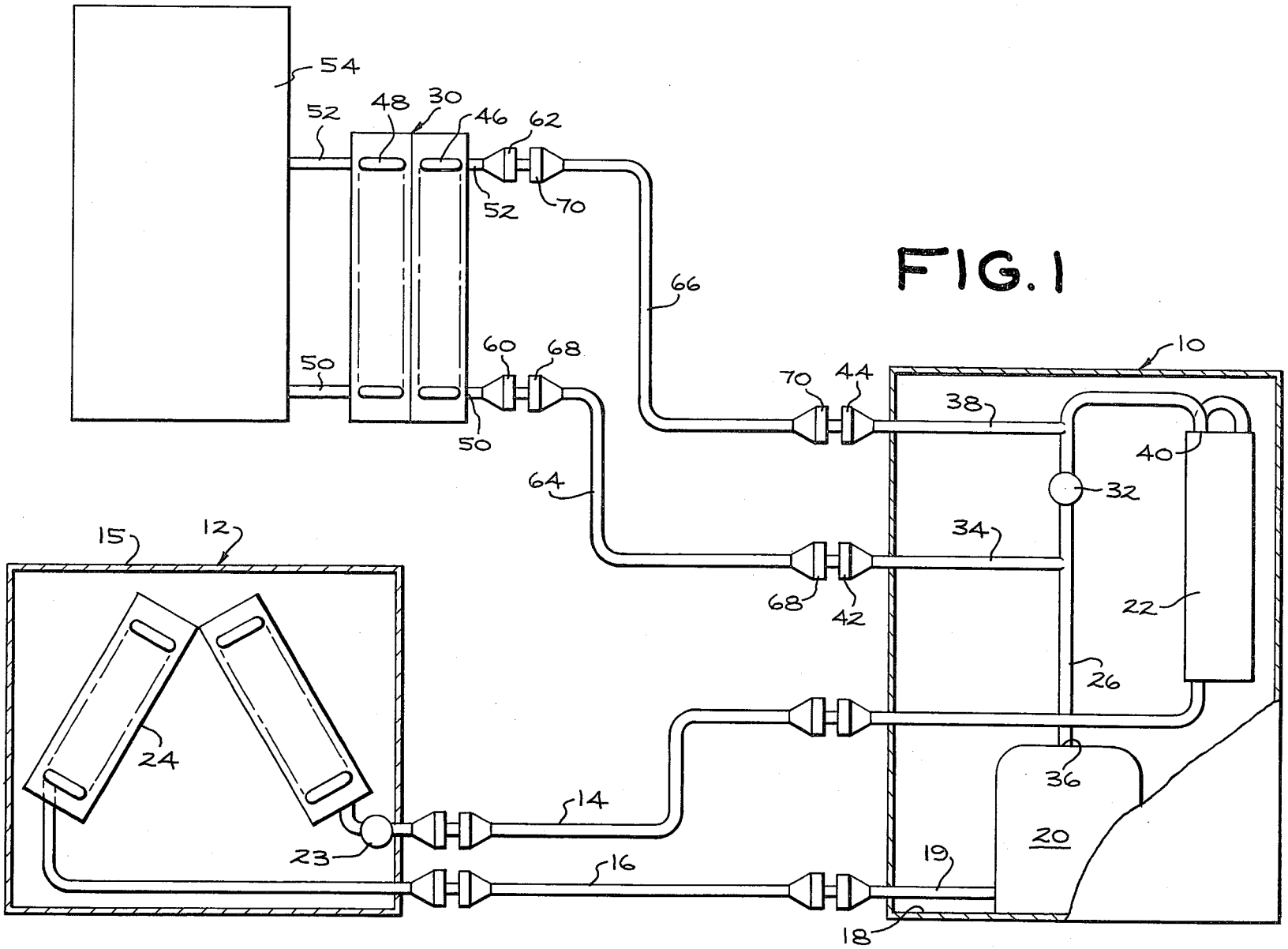
FIG. 1 is a schematic view of a split system air conditioner incorporating the present invention.

Referring to FIG. 1 of the drawing, a combination split system air conditioner is diagrammatically represented. The system comprises generally an outdoor section 10 and an indoor section 12 interconnected by lines 14 and 16. The line 14 which, in the present instance is the liquid line, and line 16, which is connected between the evaporator 24 outlet and suction line 19, are usually precharged with refrigerant prior to their being connected. Their connection to the precharged indoor and outdoor section thus eliminates the need of charging the system during normal installation procedures. The outdoor section, which is arranged outside of the area to be conditioned, includes a housing 18 in which is arranged the motor compressor unit 20 and the outdoor heat exchanger or in this embodiment the system condenser 22. The indoor unit 12 includes a housing 15 in which is arranged an indoor heat exchanger or system evaporator 24. The evaporator 24 being generally arranged in air flow relationship with the area to be conditioned. Typically, refrigerant flow is from the high side of the compressor which pumps hot refrigerant in gaseous form through a discharge line 26 to the condenser 22 where the hot gas is cooled and condensed to a degree at which it emerges from the condenser 22, usually in a liquid form. The liquid refrigerant then passes through line 14 to the expansion device 23. From the expansion device, two phase refrigerant flows into the evaporator 24 in the indoor section 12. While flowing through the evaporator 24, the liquid refrigerant vaporizes and absorbs heat of vaporization. From the evaporator 24, refrigerant is pumped by the compressor through line 16, suction line 19, to the low pressure side of the compressor 20.

By the present invention, means are provided for adapting the outdoor section of the split system to selectively receive a water preheating apparatus 30. To this end, the embodiment of FIG. 1 includes a valve of flow interrupting device 32 arranged in the compressor hot gas discharge line 26. The exact construction and type flow interrupting device, as employed in carrying out the present invention is not critical, and any means of interrupting refrigerant flow may be employed. The device may be a one time closure type since, as will be hereinafter explained once the device is employed to stop flow, it will not under normal circumstances be used to reinstate original refrigerant flow. A first line 34 is connected into line 26 upstream of valve 32 at a point intermediate valve 32 and the compressor discharge part 36. A second line 38 is connected into line 26 downstream of valve 32 at a point intermediate valve 32 and the condenser 22, inlet 40. The other ends of the lines 34 and 38 extend outside of the housing 18 and are provided with attachment fittings 42 and 44 respectively as are normally used to attach precharged lines which maintain the sealed integrity of the system. As fabricated into the system, the flow interrupting device 32 is in its open position and the refrigerant will accordingly flow in the normal manner as described hereinabove. At some point in time after the unit is installed in a normal air conditioning arrangement, a water preheating apparatus 30 may selectively be now installed to function in conjunction with the system hot gas discharge as now modified to include the flow interrupting device 32 and the connectors 42 and 44.

The water preheating apparatus 30 may be of any well known type, wherein the hot gas refrigerant heat may be transferred to the water by wrapping or coiling the refrigerant tubing around a water carrying heat exchanger or alternatively it may be wrapped around the hot water tank itself. In the present embodiment, as shown, the apparatus 30 may include a heat exchanger coil 46 arranged in heat transfer relationship with a water carrying coil 48. The inlet 50 and outlet 52 of coil 48 are connected to a water heater tank 54. Circulation of water between the tank 54 and coil 48 may be by natural convection or, if required, a pump (not shown) may be arranged in the line 50 to circulate water. The inlet 56 and outlet 58 of heat exchanger 46 are provided with connectors 60, 62 respectively which effectively seal and prevent loss of refrigerant charge in a manner similar to connectors 42 and 44. Other connectors or fittings may be used if proper system processing is provided at the time of installation.

In connecting the heat exchanger 30 and more specifically heat exchanger 46 into refrigerant flow with the system, a pair of refrigerant charged lines 64 and 66 are employed similar to lines 14 and 16 that connect the indoor and outdoor sections into a sealed refrigeration system. The charged line 64 includes connectors 68 at each end that are secured to connectors 42 and 60 in a manner to form a sealed connection between line 34 and the inlet 50 of heat exchanger 46. The charged line 66 includes connectors 70 at each end that are secured to connectors 44 and 62 in a manner to form a sealed connection between line 38 and the outlet 52 of heat exchanger 46.

At this time, with the connection completed between heat exchanger 46 and the hot gas refrigerant line 26 through the lines 34, 38, the valve or flow interrupting device 32 is closed. The closing or interruption of flow at this point in line 26 will cause hot refrigerant gas to flow from line 26 through lines 34, 64, heat exchanger 46 and back to line 26 upstream of the closed valve 32 and then through the system condenser 22 and then continuing in the normal manner described above. The hot gaseous refrigerant flowing through heat exchanger 46 transfers its heat to water carrying heat exchanger 48 which, as described above, circulates through the water heater tank 54 to add its heat to the water therein.

Figure 2:
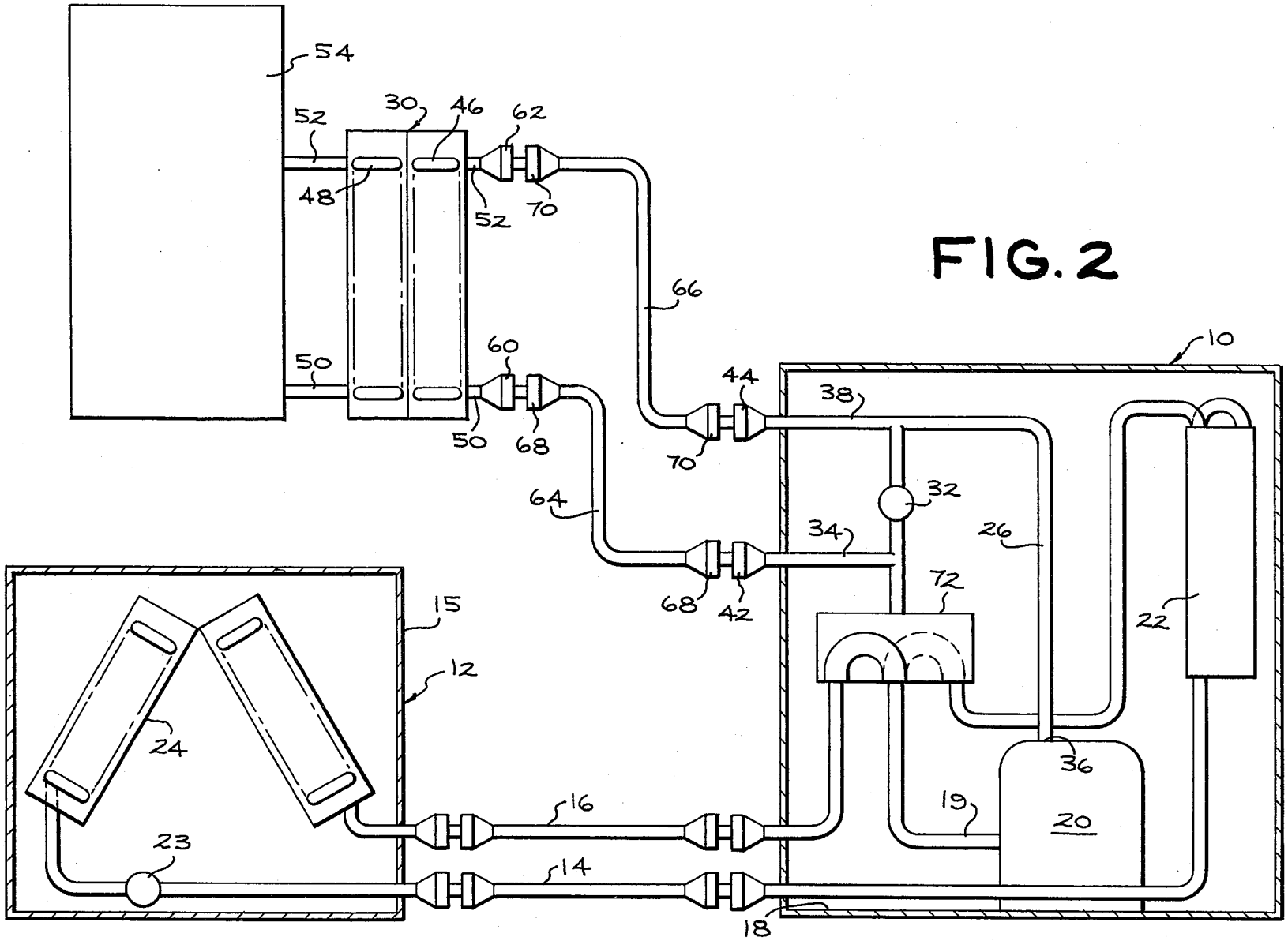
FIG. 2 is a schematic view of a split system heat pump air conditioner incorporating the present invention.

Referring to FIG. 2 of the drawings where like numerals designate like parts, there is shown an air conditioning apparatus of the reverse cycle type, commonly known as a heat pump, embodying the present water preheating arrangement. In addition to the refrigeration system illustrated in FIG. 1 of the drawings, the reverse cycle system of FIG. 2 incorporates a suitable reversing valve 72, preferably a four-way reversing valve, for the purpose of reversing refrigerant flow through a portion of the system in order to obtain the desired heating and cooling effects.

The reversing valve 72, when in the solid line position shown, is in the cooling mode and the relatively hot high pressure gaseous refrigerant from compressor 20 flows through the valve 72, line 26, to the outdoor heat exchanger 22 functioning as the condenser, while the relatively low pressure gaseous refrigerant from the indoor heat exchanger 24, functioning as the evaporator, is returned through reversing valve 72 to the compressor 20 through suction line 19. The system accordingly operates on the cooling cycle as the system of FIG. 1 does.

Actuation of the reversing valve placing the valve 72 in the dotted line position whereby relatively high pressure gaseous refrigerant discharged from the compressor 20 flows through valve 72, line 14, to the indoor heat exchanger 24 now functioning as the system's condenser, while the relatively low pressure gaseous refrigerant from the outdoor heat exchanger functioning as the evaporator passes through the valve 72 to the compressor 20 through suction line 19.

It should be noted that the lines 34 and 38 are connected to the discharge line 26 through which the relatively hot gaseous refrigerant flows, whether the system is in the cooling or heating mode. Accordingly, the arrangement, as applied to the heat pump effectively, adapts it to receive the water preheating apparatus 30.

It should be apparent to those skilled in the art that the embodiment described heretofore is considered to be presently preferred form of this invention. In accordance with the Patent Statutes, changes may be made in the disclosed apparatus and the manner in which it is used without actually departing from the true spirit and scope of this invention.

What is claimed is:

1. In a split refrigeration heat pump system air conditioner for operation in a heating or cooling mode comprising an outdoor section including a housing having a compressor and an outdoor heat exchanger, and an indoor section having an indoor heat exchanger, one end of said indoor heat exchanger being interchangeably connected by a reversing means to said compressor inlet through a suction line or said compressor outlet through a discharge refrigerant line, the other end of said indoor heat exchanger being connected to one end of said outdoor heat exchanger by a second refrigerant line, the other end of said outdoor heat exchanger being interchangeably connected by said reversing means to the outlet of said compressor through said discharge line or said suction line, means adapting said outdoor section for selectively connecting an auxiliary heat exchanger in permanent series flow relationship with the heat exchanger in said system functioning as the system condenser comprising;

a valve means in said discharge line being arranged intermediate said compressor outlet and said other end of said outdoor heat exchanger;

a first line means in said outdoor section having one end connected to said discharge line between said compressor outlet and said reversing means, the other end of said line being provided with sealed connector means arranged outside said outdoor section;

a second line means in said outdoor section having one end connected to said discharge line between said reversing means and said valve, the other end of said line being provided with sealed connector means arranged outside said outdoor housing;

an auxiliary heat exchanger connected in bypass relationship to said flow interrupting means;

means for placing water in heat exchange relationship with said auxiliary heat exchanger;

connecting means associated with the inlet and outlet of said auxiliary heat exchanger, said connecting means being operable when selectively connected to said first and second line means connectors to establish a series flow between said auxiliary heat exchanger and said heat exchanger functioning as the condenser when said valve means is selectively closed so that all of the hot gaseous refrigerant flowing through said discharge line will always flow in series through said auxiliary heat exchanger, regardless of the system operating mode.

* * * * *